United States Patent [19]

Rodenberger et al.

[11] 4,202,674

[45] May 13, 1980

[54] ELECTROSTATIC GAS CLEANER

[75] Inventors: Phillip R. Rodenberger; William A. Smith, both of Muncie, Ind.

[73] Assignee: Ball Corporation, Muncie, Ind.

[21] Appl. No.: 942,763

[22] Filed: Sep. 15, 1978

[51] Int. Cl.[2] ..... B03C 3/14; B03C 3/41; B03C 3/74

[52] U.S. Cl. ..... 55/108; 55/124; 55/129; 55/146; 55/147; 55/150

[58] Field of Search ..... 55/108, 124, 126, 127, 55/129, 135, 140, 146, 147, 149, 150, 229

[56] References Cited

U.S. PATENT DOCUMENTS

| | | | |
|---|---|---|---|
| 2,594,805 | 4/1952 | Rommel | 55/127 |
| 2,864,459 | 12/1958 | Gustafsson | 55/135 |
| 3,181,285 | 5/1965 | Tepolt et al. | 55/146 |
| 3,425,189 | 2/1969 | Haselmayer | 55/129 |
| 3,443,362 | 5/1969 | Ebert | 55/127 |
| 3,478,494 | 11/1969 | Lustenader et al. | 55/146 |
| 3,599,399 | 8/1971 | Gallen | 55/139 |
| 3,606,159 | 9/1971 | Sutton | 55/229 |
| 3,988,128 | 10/1976 | Hogg | 55/139 |
| 3,988,131 | 10/1976 | Kanazawa et al. | 55/124 |
| 4,000,994 | 1/1977 | Youhouse | 55/149 |
| 4,022,594 | 5/1977 | Bayser | 55/147 |

FOREIGN PATENT DOCUMENTS

| | | | |
|---|---|---|---|
| 562893 | 7/1930 | Fed. Rep. of Germany | 55/127 |
| 1902529 | 8/1970 | Fed. Rep. of Germany | 55/135 |
| 122438 | 1/1919 | United Kingdom | 55/135 |
| 258521 | 4/1970 | U.S.S.R. | 55/149 |

*Primary Examiner*—David L. Lacey

*Attorney, Agent, or Firm*—Jenkins, Coffey, Hyland, Badger & Conard

[57] ABSTRACT

An electrostatic gas cleaner can be provided to remove particulate matter, including particles of fluid, from gas exhausted from other apparatus. Such an electrostatic gas cleaner consists of wall means forming a large open flow path for gas to be cleaned. An electrode carrier is removably supported within said wall means and includes a plurality of projecting and electrically non-conductive portions to position and support the electrode carrier within the wall means and to position and support an electrode with respect to the wall means. The electrode carried by the electrode carrier creates an electrostatic field within the wall means. A gas to be cleaned is uniformly distributed and directed through the large open flow path formed by the wall means by a closure means at one end of the wall means. The electrostatic field from the electrode to the wall means charges and deposits particles carried by said gas on said wall means before they pass from the gas cleaner. Preferably, the wall means is in the form of a grounded metallic cylinder which is heated by electrical heating means. The electrode carrier preferably includes a metallic tube and a plurality of radially extending and electrically non-conductive rods at each end of the metallic tube to support the metallic rod on the axis of the cylindrical wall means. An electrode wire is arrayed between the radially extending rods and between the metallic rod and the cylindrical wall to provide an electrostatic field extending radially from said wire electrode to said metallic rod and to said cylindrical wall.

11 Claims, 3 Drawing Figures

ELECTROSTATIC GAS CLEANER

This invention relates to an electrostatic gas cleaner and particularly to an electrostatic gas cleaner which is compact and can be used with other industrial apparatus to remove particulate matter from their exhaust.

Electrostatic gas cleaners are known. Examples of such electrostatic gas cleaners are disclosed in U.S. Pat. No. 3,482,375; U.S. Pat. No. 3,668,836, and U.S. Pat. No. 3,826,063. In contrast to these prior electrostatic gas cleaners, this invention provides a compact electrostatic cleaner that may be added to existing industrial processing equipment, that provides for an easily removable electrode structure and that has a large open interior that is easily cleaned and maintained.

Electrostatic gas cleaners of the invention include wall means forming a large open flow path for gas through the interior of the cleaner. An electrode carrier is removably supported within the wall means and includes a plurality of projecting and electrically non-conductive portions to position and support the electrode carrier within the wall means and to position and support an electrode with respect to the wall means. One end of the wall means is closed by a closure means removably fastened to the wall and including means to uniformly distribute and direct the gas to be cleaned through the large open flow path formed by the wall means. The other end of the wall means is closed by a second closure means forming an exhaust for the cleaned gas. The electrode carried by the electrode carrier within the wall means, when connected with a source of high voltage, creates an electrostatic field within the wall means and charges and deposits particles carried by the gas to be cleaned on the wall means.

Preferably, an electrostatic gas cleaner of this invention includes an interior wall in the form of a grounded metallic cylinder which is heated by electrical heaters. The electrode carrier includes a grounded metallic tube supported and positioned on the axis of the cylindrical interior wall by a plurality of radially extending and electrically non-conductive rods at each end of the metallic tube. The electrode includes a wire arrayed between the radially extending rods at each end of the metallic tube intermediately of the metallic tube and the cylindrical wall. The electrode wire is strung back and forth between the radially projecting rods at each end of the metallic tube and fastened to such rods midway between the metallic tube and the grounded metallic cylinder to provide an electrostatic field within the cleaner extending radially from the wire electrode to both the metallic tube and the cylindrical wall.

Thus the invention can provide an electrostatic air cleaner with a large open flow path for gas to be cleaned and from which the interior electrode structure may be easily removed. Such an air cleaner can remove solid and fluid particulate matter carried from the gas exhaust of other industrial processes. The electrostatic air cleaner can remove such particulate matter for long periods of operation without the deposit of the particulate matter within the gas cleaner interferring with this operation. Furthermore, the interior walls of the gas cleaner can be heated and the gas cleaner can be supported so that fluid matter collected within the gas cleaner will constantly drain from the cleaner during its operation.

Further features and advantages of the invention will be apparent from the description and drawings which follow:

Many industrial processes and apparatus produce airborne particulate matter which should be collected in such a manner that it can be readily disposed of without contamination of the industrial plant or environment. Among such processes, for example, is a provision of lubricating material to metal sheet and strip. In the production of metal cans, it is often necessary to provide slight amounts of lubrication material on the surface of a metal sheet or strip before subjecting the metal stock to further forming operations, such as passing the stock through various forming dies. Metal stock is, therefore, provided with particulate coatings of lubricating materials which frequently include lubricating materials which are non-fluid at room temperature.

In providing metal sheets with such lubrication, it is frequently not possible to deposit all the particles of lubricating material onto the metal sheets. Many such particles are frequently carried from the lubricating apparatus. It is advisable that such lubricating material, which can include material such as oils and waxes, be collected prior to escape into the plant atmosphere. An electrostatic air cleaner of this invention may be easily and conveniently added to such processes and apparatus, and to other processes and apparatus in which particulate contaminates may otherwise be carried into the atmosphere, to remove particulate material carried in their exhaust gases for disposal without contamination of the atmosphere.

Figure 1:
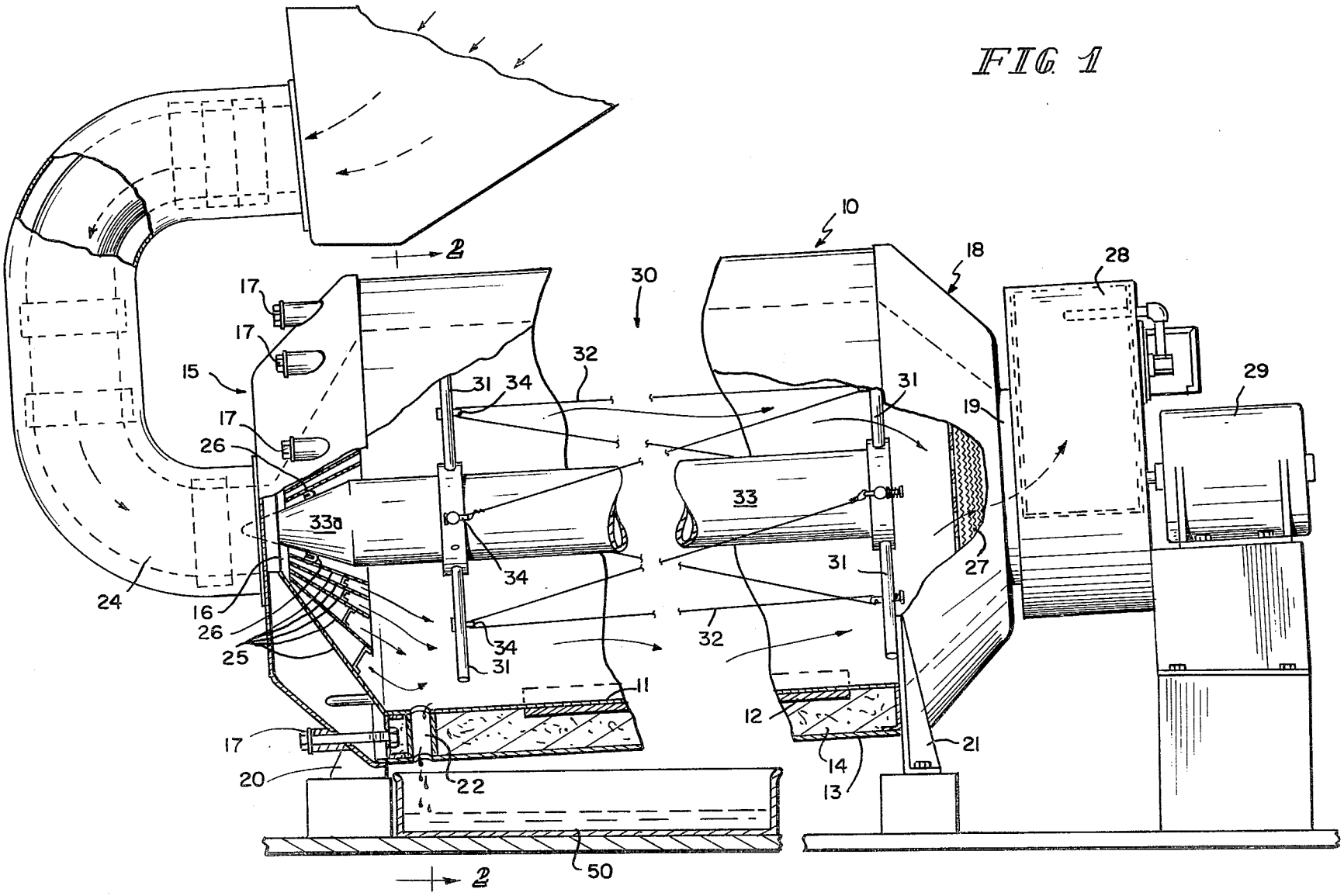
FIG. 1 is a partial cross-sectional view of an apparatus of this invention.
Figure 2:
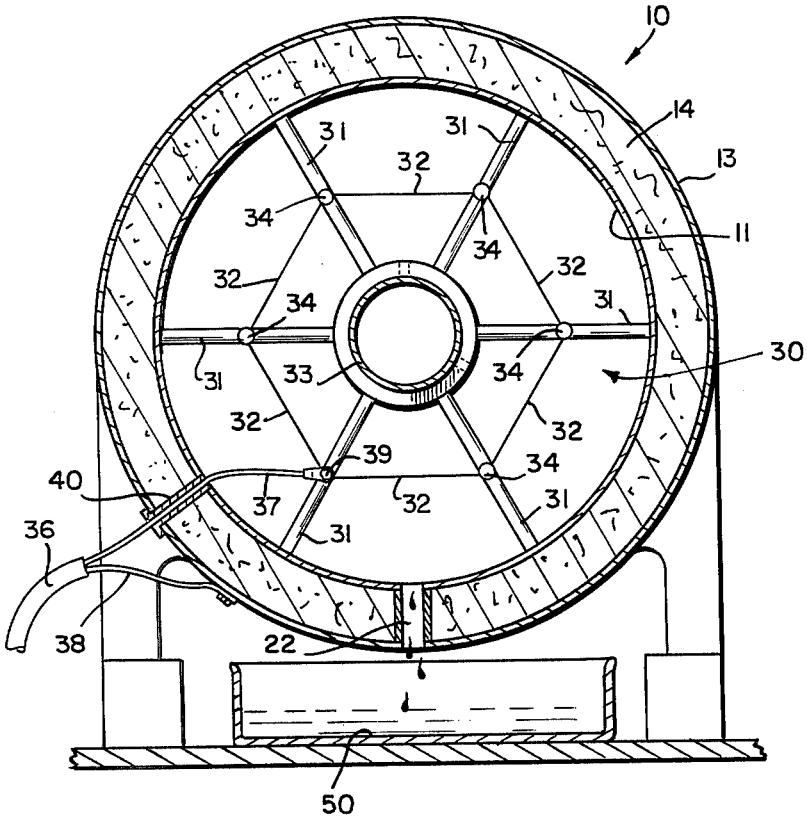
FIG. 2 is a cross-sectional view of the apparatus of FIG. 1 taken along verticle line 2—2 of FIG. 1.

Referring now to the drawings, and particularly FIG. 1, an apparatus 10 embodying this invention is illustrated. Wall means 11 form a large open flow path for gas to be cleaned, as shown in FIG. 2. The wall means 11 are preferably in the form of a grounded metallic cylinder and can have an interior diameter of approximately 18 inches. Attached to the outer surface of the wall means 11 are preferably a plurality of electrical heaters 12. An outer casing 13 is provided around the wall means 11 and defines a space 14 filled with thermal insulation. The large open flow path formed by wall means 11 is closed by closure means at each end of the flow path. The first closure means 15 forms an inlet 16 and is removably fastened to wall means 11 by a plurality of fasteners 17. The second closure means 18 forms an exhaust 19 for the gas cleaner. The gas cleaner may be provided with base supports 20 and 21 elevating the exhaust end of the gas cleaner above the inlet end to permit fluid materials collected within the gas cleaner to drain through outlet 22.

Figure 3:
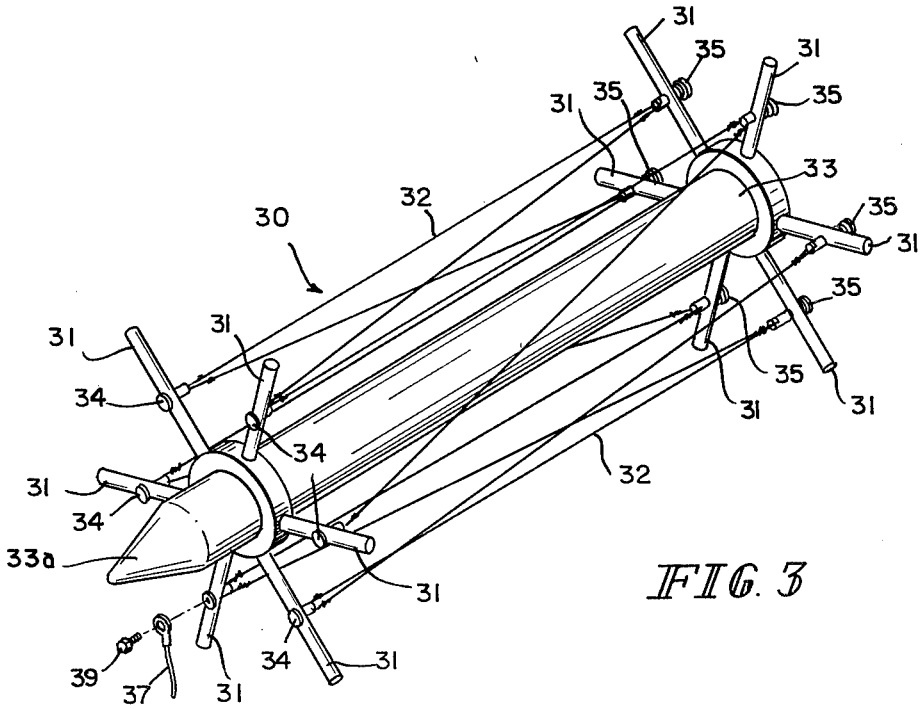
FIG. 3 is a perspective view of the removable electrode carrier means removed from within the apparatus.

An electrode carrier 30, shown in FIG. 3, is removably supported within wall means 11. By removably supported we mean that the electrode carrier 30 is supported and carried within the wall means 11 so that upon removal of a closure means at one end of the wall means 11, the electrode carrier 30 may be easily pulled from within the wall means 11. The electrode carrier includes a plurality of projecting and electrically non-conductive portions 31 to position and support the electrode carrier 30 within the wall means 11. The projecting and electrically non-conductive portions of the electrode carrier further position and support electrode means 32.

Where the wall means 11 is a grounded metallic cylinder, the electrode carrier 30 is preferably in the form of a grounded metallic tube 33 supported on the axis of the cylindrical inner wall formed by wall means 11 by the radially extending rods 31 at each end of the metallic tube 33 as shown in FIG. 3. The radially extending and electrically non-conductive rods may be made of any material which does not provide a significant flow of electric charge in the presence of a direct current high voltage. Such materials include ceramics, polyethylene, polypropylene, nylon, epoxy and the like. The wire electrode 32 is preferably music wire having a diameter of 0.009 inches and is strung back and forth between the rods 31 at the ends of the metallic cylinder 33 as shown in FIG. 1 and FIG. 3. At each rod 31 wire electrode 32 is supported midway between the metallic rod 33 and the wall means 11. At one end of the metallic rod 33 the wire electrode 32 is supported from the plurality of rods by a plurality of connectors 34 forming openings through which the wires 32 are strung. At the other end of the metallic rod 33 the wire electrode 32 is tensioned by spring loaded fasteners 35 exerting approximately three pounds of force on the wire electrode 32.

The electrode wire 32 is connected to a source of high voltage by a high voltage cable 36 attached to the wire electrode 32 as shown in FIGS. 2 and 3. The high voltage cable includes an insulated conductor 37. The insulated conductor 37 is comprised of a central conductor insulated, for example, by a high grade polyethylene insulation with a thickness around the conductor on the order of 1/10 to ⅛ of an inch. Cable 36 also includes a metallic outer braid 38 connected to cleaner 10 as shown in FIG. 2 to provide a ground return for the current from the high voltage supply. The high voltage conductor from the high voltage supply may be connected to the wire electrode 32 by any convenient means such as the threaded fastener 39 shown in FIGS. 2 and 3. An insulated grommet 40 provides the path for entry of the high voltage conductor into the gas cleaner and adds dielectric protection between the high voltage conductor and the grounded wall means 11 of the gas cleaner.

Closure 15 is bolted to wall means 11 by a plurality of threaded fasteners 17 so that it may be easily removed from the gas cleaner. Closure 15 forms an inlet opening 16 connectable with the duct work 24 leading from a source of gas to be cleaned. Carried within the first closure 15 are a plurality of vanes 25 to distribute and direct the gas entering inlet 16 uniformly through the large open flow path formed by wall means 11. Where the wall means 11 forms a cylindrical flow path, the distributing vanes 25 are preferably in the form of a plurality of nested truncated conical vanes splitting the flow of gas at inlet 16 and directing it uniformly across the cylindrical flow path. Metallic tube 33 has a tubular end **33*a* to cooperate with the plurality of truncated conical vanes 25 in distributing and directing gas to be cleaned within the gas cleaner. The innermost of the plurality of vanes 25 can carry a plurality of bent springs 26. When the first closure 15 is fastened to the gas cleaner, the spring members 26 contact the conical forward portion 33*a* of metallic rod 33 maintaining the metallic rod 33 at ground potential and providing return path for electrical current between the wire electrodes 32 and the metallic rod 33**.

As shown in FIG. 1, the second closure means 18 may carry an expanded metal filter 27 and an exhaust blower 28 driven by a motor 29 to assist the removal of clean gas from the gas cleaner.

In operation gas to be cleaned is directed through the gas cleaner through inlet 16 at approximately 150 cubic feet per minute. The wire electrodes 32 are charged to a voltage on the order of 40,000 volts direct current. Although a filtered, full-wave rectified, direct current is preferable, a filtered half-wave rectified, direct current may be used. The high voltage supply should be capable of providing two to three milliamps of current at 40,000 volts d.c. With such high voltage applied to the electrode wires 32 in the preferred embodiment, an electrostatic field is created from the wires 32 radially throughout the open flow path for the gas from the electrode wires 32 to wall means 11 and to metallic rod 33. Electrical ions are formed in the flow path by the electrostatic field and travel in response to the electrostatic field generally radially and transversely across the flow path for the gas. The gas and any particulate material that it carries in its travel through the open flow path, must pass through the ion bombardment created by the electrostatic field within wall means 11. Particulate matter carried by said gas becomes charged by the ion bombardment and urged under the influence of the electrostatic field to wall means 11 and metallic rod 33. Such particulate matter is thus removed from the gas entering inlet 16 and collected within the gas cleaner prior to leaving the gas cleaner.

Where fluid materials are to be collected, the gas cleaner should be oriented so that fluid materials collected on the walls of the passageway will flow under the influence of gravity to one end of the apparatus from which they may be drained. As shown in FIG. 1, wall means 11 is supported by base members 20 and 21 so that the end of the gas flow path adjacent inlet 16 is lower than the gas cleaner exhaust 19. Thus, fluid materials collected upon the walls of the gas cleaner will flow downwardly over the walls and to the left as shown in FIG. 1. A drain hole 22 is provided in wall means 11 to permit fluid material to flow under the influence of gravity into a collection container 50 shown in FIGS. 1 and 2.

Where the gas to be cleaned includes a normally non-fluid material such as wax, the wall means 11 can be provided with electrical heaters 12. The temperature of the interior of the gas cleaner 10 can be maintained at such an elevated temperature that wax particles deposited on the wall means 11 and the metallic rod 33 are liquified and provided with sufficient fluidity to flow into the container 50.

Apparatus, such as that described, can provide a small compact modular gas cleaner than can be added to and used with many industrial methods and processes to remove airborne particulate matter generated in the use of such methods and processes. Such apparatus can remove unwanted particulate matter and can provide a flow of clean gas to the environment or the industrial plant. The large open flow path within the gas cleaner permits operations for long intervals without the necessity of shutting down to remove collected material from within the cleaner. The gas cleaner is however easily disassembled for maintenance and cleaning and, when disassembled, is easily cleaned.

The preferred embodiment illustrated and described is capable of many modifications without departing from the spirit and scope of our invention as set forth in the following claims.

We claim:

1. An electrostatic gas cleaner, comprising an electrically grounded cylindrical wall forming a large open flow path for gas to be cleaned having an inlet at one end and an outlet at the other end, a removable electrode carrier positioned within the cylindrical wall and including a central tubular support having a plurality of projecting rods of electrically non-conductive material at each end of the central tubular support to engage the cylindrical wall and support the electrode carrier coaxially within the cylindrical wall, a wire electrode connected to the plurality of projecting rods, said wire electrode being fastened adjacent the center of each of the projecting rods and strung between the rods at each end of the central tubular support in a cylindrical array, an inlet closure having an inlet opening and including a plurality of gas distributing vanes positioned at the inlet end of the large open flow path, an exhaust closure having an exhaust opening at the outlet end of the large open flow path means connected to the exhaust closure for urging gas through said cleaner, and means to charge the wire electrode to remove particulate matter carried by said gas and deposit said particulate matter on the walls of said gas cleaner.

2. The electrostatic gas cleaner of claim 1 wherein said gas distributing vanes are truncated and conical, said central tubular support is metallic and includes a conical end fitted within the plurality of truncated conical gas distributing vanes and is electrically connected to ground by spring means positioned between said central tubular support and the innermost of said truncated conical vanes.

3. The electrostatic gas cleaner of claim 1 wherein the exhaust closure contains a metallic filter and is supported at a higher position than the inlet closure by base members supporting the electrostatic gas cleaner.

4. An electrostatic gas cleaner, comprising a wall means forming a large open flow path for gas to be cleaned, an electrode carrier means removably supported within said wall means and including a plurality of projecting and electrically non-conductive portions to position and support said electrode carrier means within said wall means and to position and support electrode means within said wall means, electrode means connected to said electrode carrier means within said wall means to create an electrostatic field within said wall means, first closure means at one end of said wall means including an inlet opening and means to uniformly distribute and direct the gas to be cleaned through the large open flow path within said wall means so that particles carried by said gas are electrostatically charged and deposited within said wall means, and second closure means at the other end of the wall means having an outlet opening for exhausting the cleaned gas.

5. The electrostatic gas cleaner of claim 4 wherein said wall means comprises a grounded metallic cylinder which is heated by electrical heating means, said electrode carrier means includes a metallic tube, said plurality of projecting and electrically non-conductive portions includes a plurality of radially extending rods at each end of the metallic tube and supporting the metallic tube on the axis of the grounded metallic cylinder, and said electrode means includes a wire arrayed in a cylindrical-like network between the radially extending rods intermediate the metallic tube and the cylindrical wall, said metallic tube being electrically connected with the grounded metallic cylinder to provide an electrostatic field within the cleaner extending radially from said wire electrode network and to said metallic tube and cylindrical wall.

6. The electrostatic gas cleaner of claim 4, wherein the wall means is supported by a base with the second closure being at a higher position than the first closure, the second closure contains a metallic filter positioned therein and is further connected with an exhaust fan, wherein said distributing means comprises a plurality of distributing vanes, and said wall means having an opening to permit fluid material collected within the gas cleaner to drain from the cleaner.

7. An electrostatic gas cleaner, comprising a base to support the cleaner so that one end is lower than the other end, an outer casing supported by the base, an inner cylindrical wall carried by but thermally isolated from the outer casing, an electrical heater attached to said inner cylindrical wall, a central tubular member having a plurality of spoke-like rods projecting radially from each end of the tubular member, said plurality of radially projecting rods being formed of electrically non-conductive material and extending between the central tubular member and the inner cylindrical wall to support and position the central tubular member on the axis of the inner cylindrical wall, a wire electrode located between the radially projecting spoke-like rods at each end of the central tubular member and fastened intermediate the ends of each spoke-like projecting rod to form a cylindrical wire array intermediate the central tubular member and the inner cylindrical wall, means to charge the wire electrode to high voltage, a first closure removably fastened to one end of the outer casing and including an inlet for gas to be cleaned and including a plurality of truncated conical vanes to distribute the gas to be cleaned uniformly between the central tubular member and the inner cylindrical wall, and a second closure fastened to the other end of the outer casing and including an exhaust for the cleaned gas.

8. The electrostatic gas cleaner of claim 7 wherein the means to charge the wire electrode to high voltage includes a high voltage supply with an output of about 40,000 volts direct current, a high voltage cable including an insulated central high voltage conductor and an outer braided conductor that is grounded at the high voltage supply, a grommet of electrically non-conductive material to isolate the insulated high voltage conductor from the outer casing and inner cylindrical wall at its entry within the gas cleaner, and means to attach the high voltage conductor to the wire electrode.

9. The electrostatic gas cleaner of claim 7 wherein the wire electrode is held to the spoke-like projecting rods at one end of the central tubular member and fastened to the spoke-like projecting rods at the other end of the central tubular member by spring-loaded fasteners to tension the wire in the cylindrical array.

10. An electrostatic gas cleaner, comprising an electrically grounded cylindrical wall forming a large open flow path for gas to be cleaned having an inlet at one end and an outlet at the other end, a removable electrode carrier positioned within the cylindrical wall and including a central tubular support having a plurality of projecting rods of electrically non-conductive material at each end of the central tubular support to engage the cylindrical wall and support the electrode carrier coaxially within the cylindrical wall, a wire electrode connected to the plurality of projecting rods, said wire electrode being fastened adjacent the center of each of the projecting rods and strung between the rods at each end of the central tubular support in a cylindrical array, an inlet closure including an inlet opening and including a plurality of gas distributing vanes at the inlet end of the large open flow path, an exhaust closure including an exhaust opening at the outlet end of the large open flow path, said outlet end of the large open flow path being supported higher than the inlet end by a base member supporting the electrostatic gas cleaner, said exhaust closure including a metallic filter and an exhaust fan for urging gas through said cleaner, and means to charge the wire electrode to remove particulate matter carried by said gas and deposit said particulate matter on the walls of said gas cleaner.

11. An electrostatic gas cleaner, comprising a wall means forming a large open flow path for gas to be cleaned having an opening to permit fluid material collected within the gas cleaner to drain from said cleaner, an electrode carrier means removably supported within said wall means and including a plurality of projecting and electrically non-conductive portions to position and support said electrode carrier means within said wall means and to position and support electrode means within said wall means, electrode means carried by said electrode carrier means within said wall means to create an electrostatic field within said wall means, first closure means at one end of said wall means including a gas inlet and carrying a plurality of distributing vanes to uniformly distribute and direct the gas to be cleaned through the large open flow path within said wall means so that particles carried by said gas are electrostatically charged and deposited within said wall means, and second closure means at the other end of the wall means including a gas outlet for exhausting the cleaned gas and including a metallic filter connected to an exhaust fan, the wall means being supported by a base whereby the second closure is higher than the first closure.

* * * * *

UNITED STATES PATENT AND TRADEMARK OFFICE

CERTIFICATE OF CORRECTION

PATENT NO. : 4,202,674

DATED : May 13, 1980

INVENTOR(S) : Phillip R. Rodenberger and William A. Smith

It is certified that error appears in the above-identified patent and that said Letters Patent are hereby corrected as shown below:

Col. 4, line 55, delete the word "than" and substitute therefor --that--.

Col. 5, line 24, after "path" place a --,-- (comma); delete the remainder of the line line 25, begin a subparagraph inserting "means con" before "nnected" at the beginning of line 25.

Signed and Sealed this

*Second* Day of *September 1980*

[SEAL]

*Attest:*

SIDNEY A. DIAMOND

*Attesting Officer*

*Commissioner of Patents and Trademarks*